US007563138B2

(12) United States Patent
Zhang et al.

(10) Patent No.: US 7,563,138 B2
(45) Date of Patent: Jul. 21, 2009

(54) ELECTRICAL CARD CONNECTOR WITH IMPROVED CONTACTS

(75) Inventors: Shi-Gui Zhang, Kunshan (CN); Hua Yin, Kunshan (CN); Qi-Jun Zhao, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/221,570

(22) Filed: Aug. 4, 2008

(65) Prior Publication Data

US 2009/0035965 A1 Feb. 5, 2009

(30) Foreign Application Priority Data

Aug. 3, 2007 (CN) ..... 2007 2 0041184 U

(51) Int. Cl.
*H01R 24/00* (2006.01)

(52) U.S. Cl. ..... 439/630; 439/188

(58) Field of Classification Search ..... 439/630, 439/188

See application file for complete search history.

(56) References Cited

U.S. PATENT DOCUMENTS 6,135,809 A * 10/2000 Asakawa ..... 439/489
6,409,529 B1 * 6/2002 Liu et al. ..... 439/188
6,607,405 B2 8/2003 Nishimura
7,112,095 B2 * 9/2006 Shen et al. ..... 439/630
2004/0192096 A1 * 9/2004 Sato et al. ..... 439/188
2004/0259422 A1 * 12/2004 Chang ..... 439/630
2005/0003693 A1 * 1/2005 Chang ..... 439/188
2006/0079106 A1 * 4/2006 Kikuchi ..... 439/188
2006/0099856 A1 5/2006 Takei et al.

* cited by examiner

*Primary Examiner*—Gary F. Paumen
(74) *Attorney, Agent, or Firm*—Wei Te Chung

(57) ABSTRACT

An electrical card connector (100) to be mounted on a printed circuit board and includes: an insulative housing (1) having a first receiving cavity (14) for receiving a first card (300) and a second receiving cavity (13) for receiving a second card (200), and a number of passageways (132), and a number of contacts retained in the passageways respectively. The contacts include a number of first contacts (3) each having a first contacting portion (32) for contacting with the first card, a first soldering portion (35) to be soldered onto the printed circuit board and a first base portion (30) connecting with the first contacting portion and the first soldering portion; a plurality of second contacts (2) spaced from the first contacts, and defining a second base portion (21) and a second contacting portion (22) extending forwardly from the second base portion to contact with the second card. The second contacting portion (22) is deflected to contact with the corresponding first contact upon an abutting engagement between the second contacts and the second card.

20 Claims, 6 Drawing Sheets

ELECTRICAL CARD CONNECTOR WITH IMPROVED CONTACTS

BACKGROUND OF THE INVENTION

1. Field of the Invention

The present invention generally relates to an electrical card connector and more particularly to an electrical card connector having improved contacts.

2. Description of Related Art

A conventional electrical card connector is usually used in electrical equipments such as desktop, notebook, mobile phones and the like for contacting with various types of electrical card to transmit information therebetween. The electrical card connector is mounted on a printed circuit board, and comprises an insulative housing defining a front mating face and a receiving cavity extending through the front mating face, and a plurality of contacts retained in the receiving cavity. The contacts may include a plurality of first contacts to contact with a first electrical card and a number of second contacts to contact with a second electrical card. The first contacts each has a first flexible arm extending into the receiving cavity and a first soldering portion projecting outside the housing to be soldered onto the printed circuit board, similarly, the second contacts each defines a second flexible arm extending into the receiving cavity and a second soldering portion projecting outside the housing to be soldered onto the printed circuit board. However, both the first contacts and the second contacts need to be soldered onto the printed circuit board, making the soldering process more complicated.

It is thus desired to provide an electrical card connector having an improved contacts.

SUMMARY OF THE INVENTION

According one aspect of the present invention, an electrical card connector to be mounted on a printed circuit board, comprising: an insulative housing having a first receiving cavity for receiving a first card and a second receiving cavity for receiving a second card, and a number of passageways, and a number of contacts retained in the passageways respectively. The contacts include a plurality of first contacts each having a first contacting portion for contacting with the first card, a first soldering portion to be soldered onto the printed circuit board and a first base portion connecting with the first contacting portion and the first soldering portion; a plurality of second contacts spaced from the first contacts, and defining a second base portion and a second contacting portion extending forwardly from the second base portion to contact with the second card. The second contacting portion is deflected to contact with the corresponding first contact upon an abutting engagement between the second contacts and the second card.

According to another aspect of the present invention, an electrical card connector to be mounted on a printed circuit board, comprising: an insulative housing having a bottom wall, a rear wall, a first receiving cavity for receiving a first card and a second receiving cavity for receiving a second card, and a plurality of passageways formed on the bottom wall, a plurality of opening extending rearwardly through the rear wall and communicating with the passageways respectively; and a plurality of contacts retained in housing, including: a plurality of first contacts each having a first contacting portion for contacting with the first card, a first soldering portion extending outside the housing and a first base portion connecting with the first contacting portion and the first soldering portion and being disposed within the corresponding passageway; a plurality of second contacts located above the passageways, and defining a second base portion and a second contacting portion extending forwardly from the second base portion to contact with the second card; wherein the first base portion is retained on a lower portion of the opening, the second base portion is retained on an upper portion of the opening, the second contacting portions each defines a distal end which is able to extend into the passageway to contact with the first contact.

Other objects, advantages and novel features of the present invention will become more apparent from the following detailed description of the present embodiment when taken in conjunction with the accompanying drawings.

DETAILED DESCRIPTION OF THE INVENTION

Figure 1:
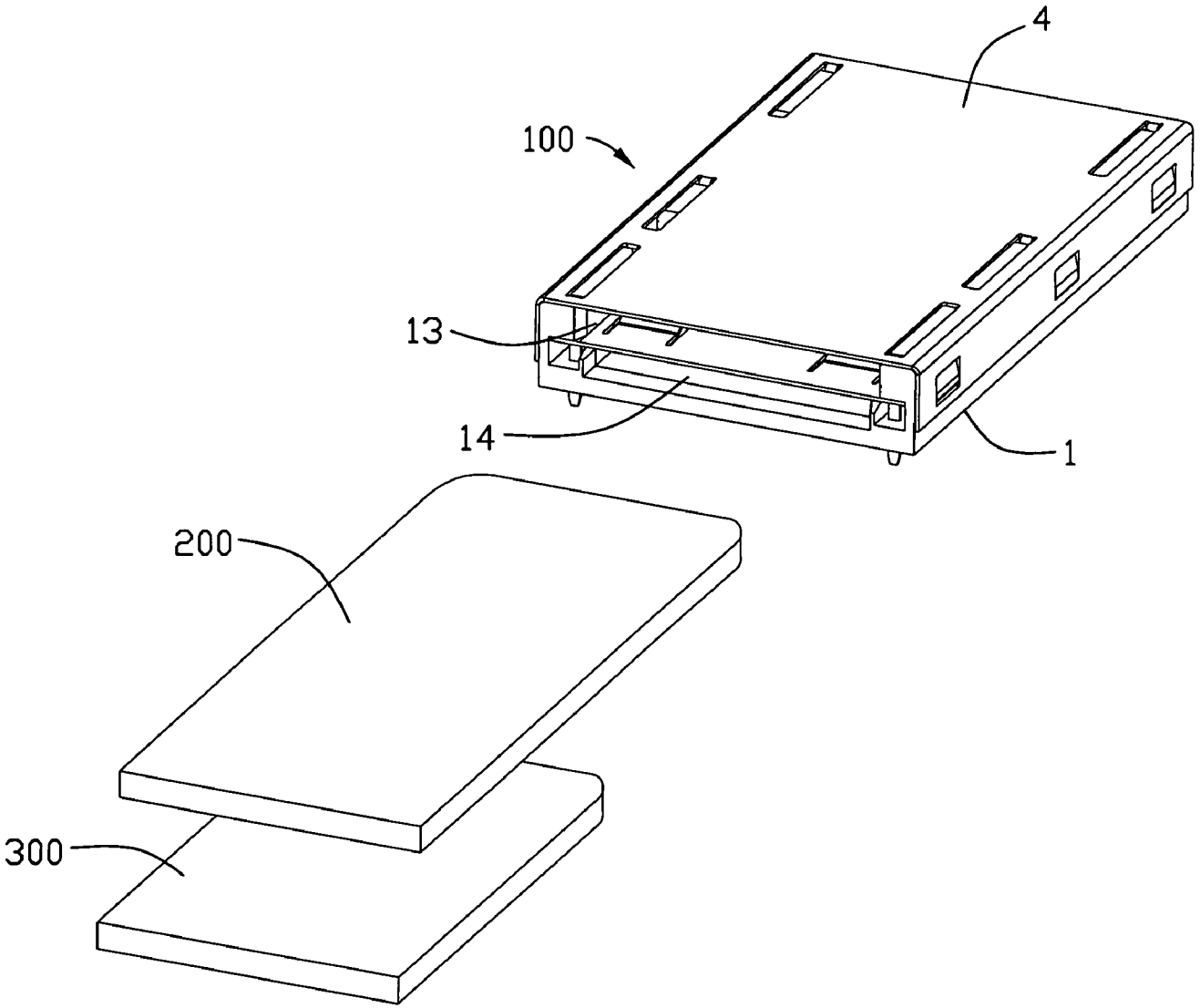
FIG. 1 is an assembled perspective view of an electrical card connector with a first card and a second card according to the present invention.

Reference will now be made to the drawing figures to describe the preferred embodiment of the present invention in detail.

Figure 2:
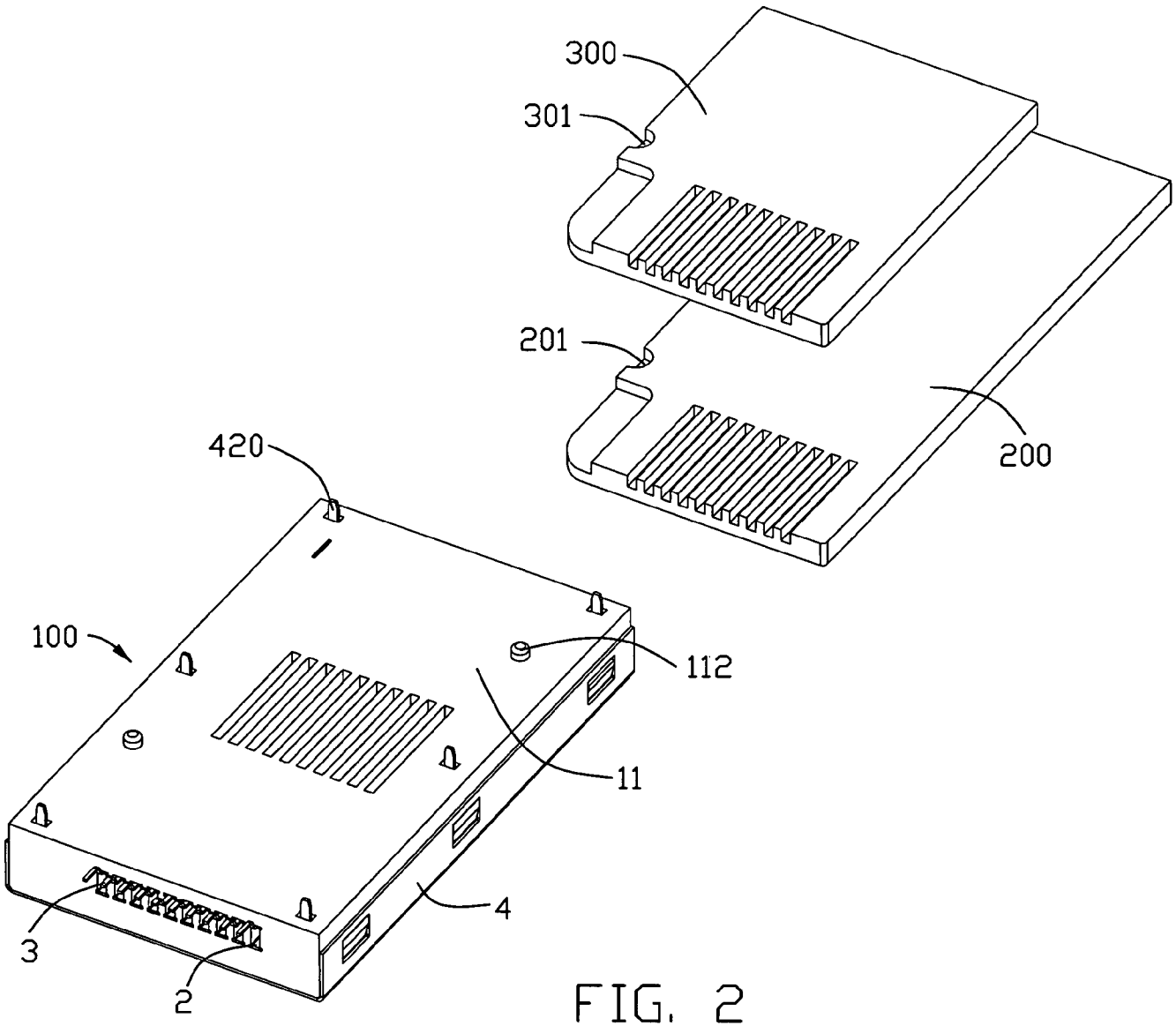
FIG. 2 is a view similar to FIG. 1, while taken from a different aspect.
Figure 3:
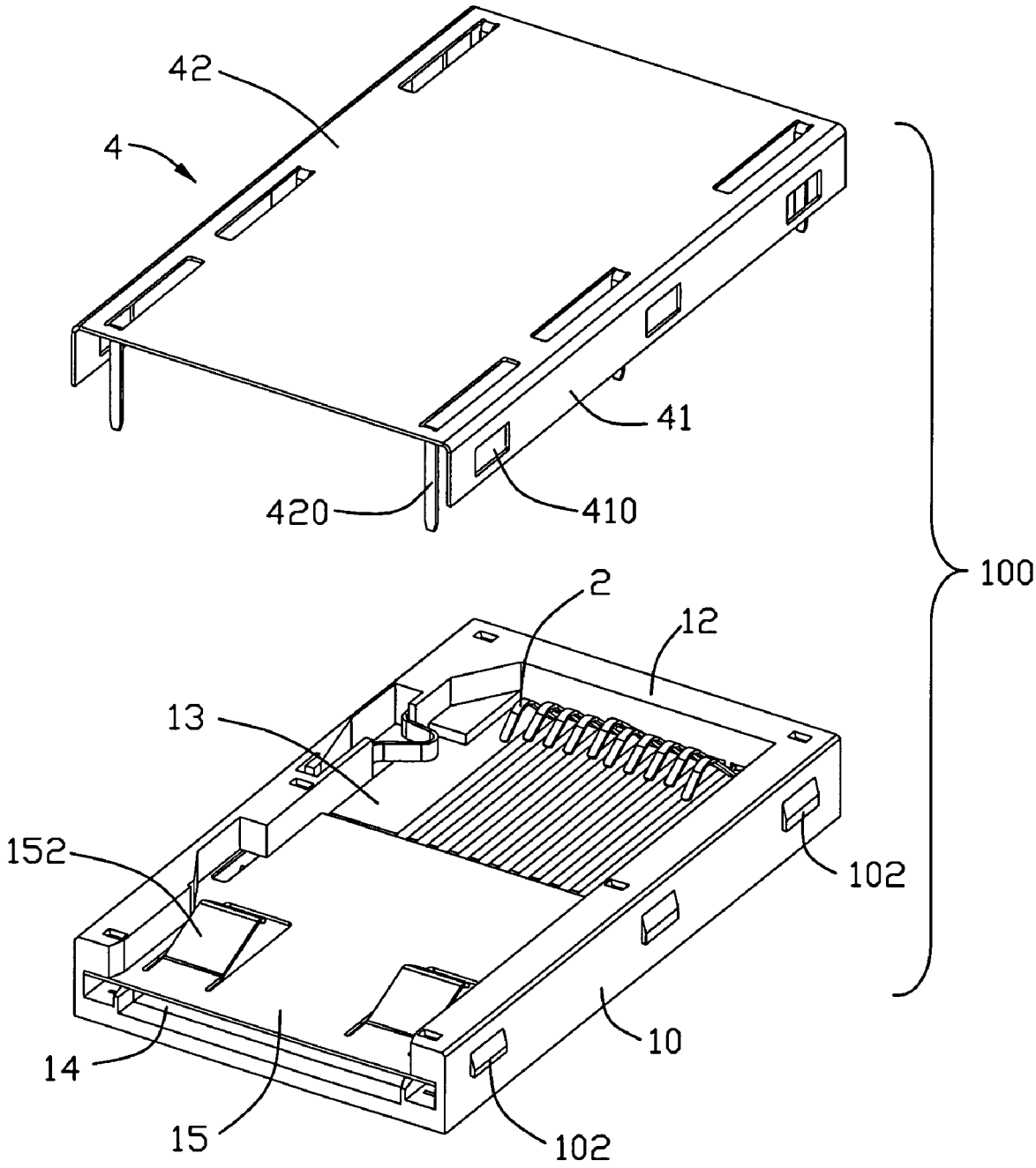
FIG. 3 is a partially exploded perspective view of the electrical card connector shown in FIG. 1.
Figure 4:
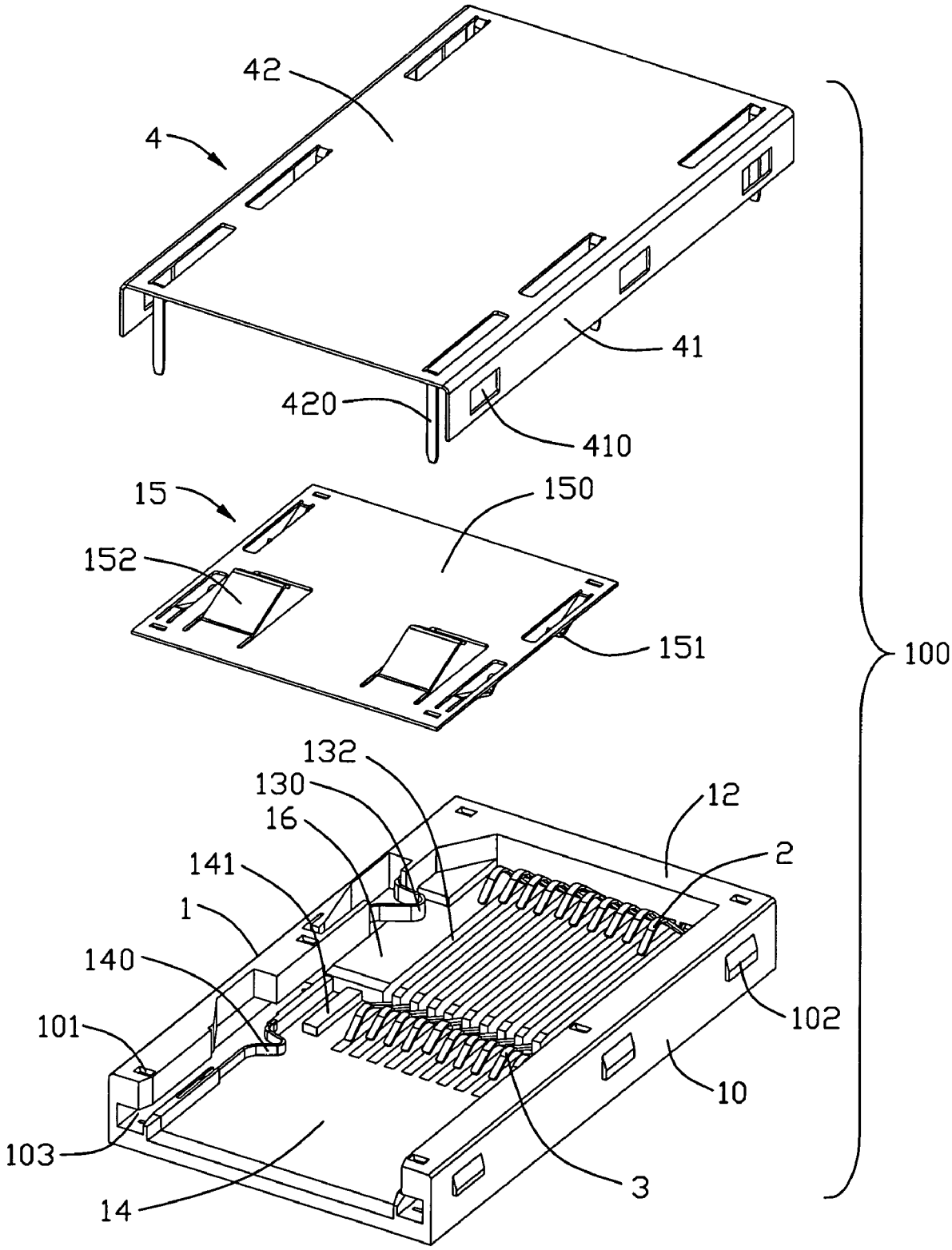
FIG. 4 is an another partially exploded perspective view of the electrical card connector shown in FIG. 3.
Figure 5:
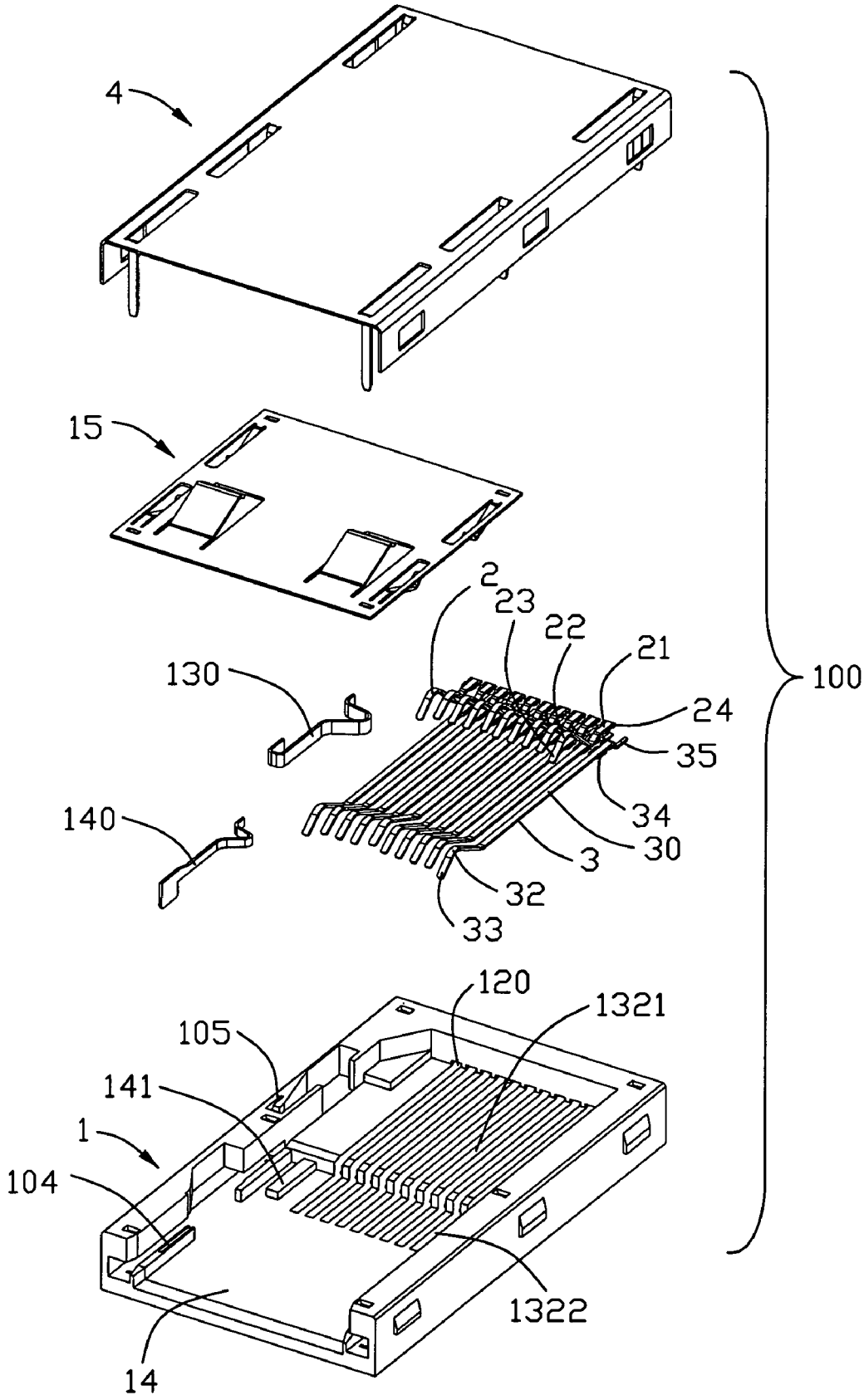
FIG. 5 is an exploded perspective view of the electrical card connector.
Figure 6:
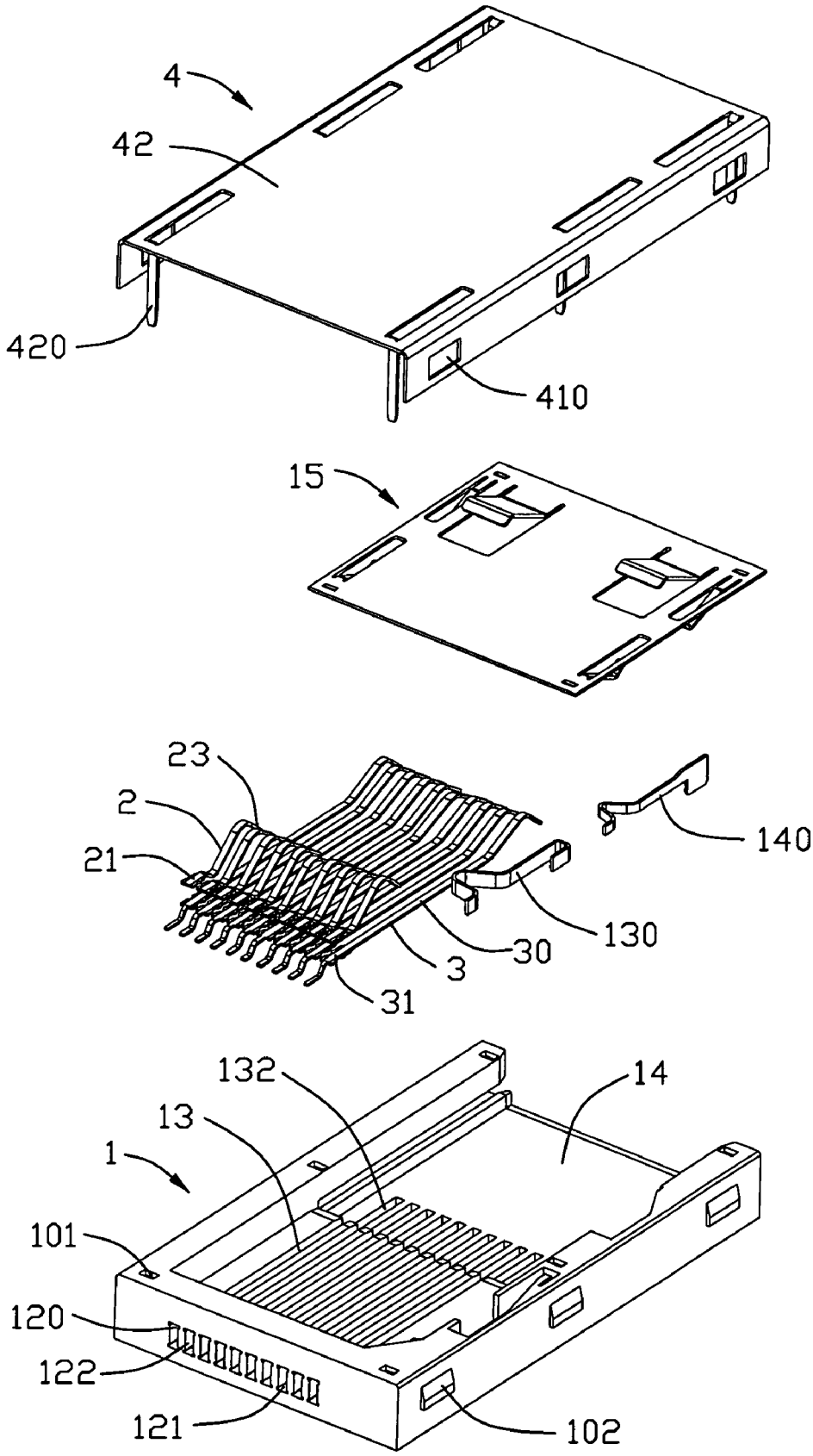
FIG. 6 is a view similar to FIG. 5, while taken from a different aspect.

Referring to FIGS. 1-4, an electrical card connector 100 according to the present invention is used for connecting a first card 300 and a second card 200 to an electronic device (not shown), comprises an insulative housing 1, a metal shell 4 covering the housing 1 to define a receiving room therebetween and a plurality of contacts mounted on the housing 1. The contacts have a plurality of first contacts 3 to contact with the first card 300 and a plurality of second contacts 2 to contact with the second card 200. The first card 300 is shorter than the second card 200. The second contacts 2 are shorter than the first contacts 3.

The first contacts 3 each has a first contacting portion 32 for contacting with the first card 300, a first soldering portion 35 extending outside the housing 1 to be soldered onto a printed circuit board (not shown) and a first base portion 30 connecting with the first contacting portion 32 and the first soldering portion 35. The second contacts 2 does not extend outside the housing 1 and each is located above the corresponding first contacts 3, and defines a second base portion 21 and a second deflectable contacting portion 22 extending forwardly from the second base portion 21. The second contacting portion 22 is located behind the first contacting portion 32. The second contacting portion 22 has a distal end 23 to contact with the first base portion 30 of the first contact 3. There is no soldering portions formed integrally with the second contacts 2, the second contacting portion 22 is configured to move downwardly to contact with the first contact 3, thereby establishing an electrical connection between the second contacts 2 and the printed circuit board. A number of barbs 24, 34 are formed on the second base portion 20 and the first base portion 30 respectively to lock with the housing 1.

The housing 1 has a bottom wall 11, a pair of side wall 10, a rear wall 12 extending upwardly from side edges of the bottom wall 11. A step portion 13 protrudes upwardly from a rear portion of the bottom wall 11. An elongated slit 103 is formed on a middle portion of the side wall 10. A metal plate 15 is retained in the slit 103 to be coplanar with an upper portion of the step portion 13, thereby dividing the receiving room into an upper receiving cavity 13 for receiving the second card 200 and a lower receiving cavity 14 for receiving the first card 300. The bottom wall 11 defines an anti-mismating block 141 extending into the lower receiving cavity 14 to be located on one side of the first contacting portions 32, thereby preventing the first card 300 being inserted along an undesirable direction.

The metal plate 15 includes a flat base wall 150, a pair of upper spring tabs 152 extending upwardly from the base wall 150 to project into the upper receiving cavity 13 and a number of lower spring tabs 151 extending downwardly from the base wall 150 to project into the lower receiving cavity 14. The upper spring tabs 152 and the lower spring tabs 151 are adapted to bias against the second card 200 and the first card 300 respectively to ensure that the second card 200 and the first card 300 is retained in the housing 1 reliably.

The bottom wall 11 is provided with a pair of posts 112 to be mounted on the printed circuit board. A plurality of passageway 132 is recessed from the bottom wall 11 and the step portion 16 to receive the first contacts 3. The passageway 132 is provided with an opening 122 extending therethrough the rear wall 12. The opening 122 includes an upper cutout 120 to retain the second base portion 21 and a lower cutout 121 to fix the first base portion 30. The second base portion 21 is located above the first base portion 30. The first soldering portion 35 extends rearwardly to be positioned outside the rear wall 12. The second contacts 2 do not extend outside the housing 1 and are connected to the printed circuit board via the corresponding second contacts 2.

The passageways 132 each includes a first portion 1321 formed on the step portion 16 and exposed to the upper receiving cavity 13, and a second portion 1322 formed on the bottom wall 11 and communicating with the first portion 1321 to be exposed to the lower receiving cavity 14, the first portion 1321 communicates with the lower cutout 121. The first base portion 30 is disposed in the first portion 1321, the distal end 23 of the second contact 2 extends into the first portion 1321 to contact with the first base portion 30 when the second card 200 deflects the second contacting portion 22 to move downwardly. The distal end 33 of the first contacting portion 32 is located above the second portion 1322 when the first card 300 is not inserted into the lower receiving cavity 14. The distal end 33 of the first contacting portion 32 extends into the second portion 1322 when the first card 300 is fully inserted into the lower receiving cavity 14 and biases against the first contacting portion 32.

The side wall 10 is formed with a front recess 104 and a rear recess 105. A first locking tab 140 is retained in the front recess 104 and extends into the lower receiving cavity 14 to lock with a side cutout 301 of the first card 300. A second locking tab 130 is retained in the rear recess 105 and extends into the upper receiving cavity 13 to lock with a side cutout 201 of the second card 200.

The metal shell 4 is configured to cover an upper portion of the housing 1 and defines a main portion 42 and a pair of side wall 41. A plurality of vertical position tabs 420 are stamped from the main portion 42. The side wall 41 is provided with a number of opening 410 to lock with a corresponding protrusion 102 formed on the side wall 10 of the housing 1. The side wall 10 of the housing 1 is formed with a number of position hole 101 to retain the position tab 420. The position tab 420 extends downwardly through the bottom wall 11 to be retained on the printed circuit board.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical card connector to be mounted on a printed circuit board, comprising:

an insulative housing having a first receiving cavity for receiving a first card and a second receiving cavity for receiving a second card, and a plurality of passageways; and a plurality of contacts retained in the passageways respectively, including:

a plurality of first contacts each having a first contacting portion for contacting with the first card, a first soldering portion to be soldered onto the printed circuit board and a first base portion connecting with the first contacting portion and the first soldering portion;

a plurality of second contacts spaced from the first contacts, and defining a second base portion and a second contacting portion extending forwardly from the second base portion to contact with the second card;

wherein the second contacting portion is deflected to contact with the corresponding first contact upon an abutting engagement between the second contacts and the second card.

2. The electrical card connector as claimed in claim 1, wherein the second contacting portion is located behind the first contacting portion.

3. The electrical card connector as claimed in claim 1, wherein the second contacts do not extend outside the housing.

4. The electrical card connector as claimed in claim 1, further comprising a metal plate, the insulative housing is formed with a slit extending rearwardly, the metal plate is retained in the slit to be positioned between the first receiving cavity and the second receiving cavity.

5. The electrical card connector as claimed in claim 4, wherein the metal plate includes a flat base wall, a first spring tab extending upwardly from the base wall to project into the second receiving cavity and a second spring tab extending downwardly from the base wall to project into the first receiving cavity.

6. The electrical card connector as claimed in claim 1, further comprising a metal cover attached to the housing, the cover defines an upper wall and a plurality of position tabs stamped downwardly from the upper wall, the housing includes a plurality of position holes to lock with the corresponding position tabs.

7. The electrical card connector as claimed in claim 1, wherein the housing include a rear wall, the passageways each includes an opening extending through the rear wall to fix the first contact and the second contact.

8. The electrical card connector as claimed in claim 7, wherein the opening includes an upper cutout and a lower cutout located below the upper cutout, the second base portion is retained in the upper cutout, the first base portion is fixed in the lower cutout to be located beneath the second base portion.

9. The electrical card connector as claimed in claim 5, wherein the housing include a bottom wall and a step portion extending upwardly from a rear portion the bottom wall, the metal plate and an upper face of the step portion are coplanar.

10. The electrical card connector as claimed in claim 9, wherein the passageways each includes a first portion formed on the step portion and exposed to the second receiving cavity and a second portion communicating with the first portion to be exposed to the first receiving cavity, the first portion communicates with the lower cutout.

11. The electrical card connector as claimed in claim 10, wherein first base portion is disposed in the first portion, the second contact defines a distal end on the contacting portion, the distal end extends into the first portion to contact with the first base portion when the second card deflects the second contacting portion to move downwardly.

12. An electrical card connector to be mounted on a printed circuit board, comprising:

an insulative housing having a bottom wall, a rear wall, a first receiving cavity for receiving a first card and a second receiving cavity for receiving a second card, and a plurality of passageways formed on the bottom wall, a plurality of opening extending rearwardly through the rear wall and communicating with the passageways respectively; and a plurality of contacts retained in housing, including:

a plurality of first contacts each having a first contacting portion for contacting with the first card, a first soldering portion extending outside the housing and a first base portion connecting with the first contacting portion and the first soldering portion and being disposed within the corresponding passageway;

a plurality of second contacts located above the passageways, and defining a second base portion and a second contacting portion extending forwardly from the second base portion to contact with the second card;

wherein the first base portion is retained on a lower portion of the opening, the second base portion is retained on an upper portion of the opening, the second contacting portions each defines a distal end which is able to extend into the passageway to contact with the first contact.

13. The electrical card connector as claimed in claim 12, wherein the bottom wall defines a anti-mismating block extending into the first receiving cavity to be located on one side of the first contacting portions.

14. The electrical card connector as claimed in claim 12, further comprising a metal cover attached to the housing, the cover defines an upper wall and a plurality of position tabs stamped downwardly from the upper wall, the housing includes a plurality of position holes to lock with the corresponding position tabs.

15. The electrical card connector as claimed in claim 12, further comprising a metal plate, the insulative housing is formed with a slit extending rearwardly, the metal plate is retained in the slit to be positioned between the first receiving cavity and the second receiving cavity.

16. The electrical card connector as claimed in claim 15, wherein the metal plate includes a flat base wall, a first spring tab extending upwardly from the base wall to project into the second receiving cavity and a second spring tab extending downwardly from the base wall to project into the first receiving cavity.

17. An electrical card connector assembling comprising:

an insulative housing unit defining a card receiving space unit and equipped with first and second sets of contacts with corresponding contacting section extending into the card receiving space unit for mechanically and electrically coupling to corresponding first and second cards thereto; and a common set of soldering sections located on a region of said housing; wherein at least one selected set of said first and second sets of contacts are essentially regularly electrically and mechanically isolated form said common set of soldering sections during no corresponding card coupled thereto, while being displaced to be electrically and mechanically engaged with said common set of soldering sections during coupling to the corresponding card.

18. The electrical card connector assembly as claimed in claim 17, wherein the other set of said first and second set of contacts are constantly mechanically and electrically engaged with the common set of soldering sections.

19. The electrical card connector assembly as claimed in claim 17, wherein said card receiving space unit is divided by a divider into two cavities for receiving the corresponding first and second card, respectively.

20. The electrical card connector assembly as claimed in claim 17, wherein the contacting sections of said at least one selected set of contacts are located behind those of the other set of contacts in a front-to-back direction.

* * * * *